US011780002B2

(12) United States Patent
Gagliardi et al.

(10) Patent No.: US 11,780,002 B2
(45) Date of Patent: Oct. 10, 2023

(54) ELECTROMAGNETIC DEVICE FOR LATERALLY CONTAINING LIQUID METAL IN A CASTING OF METAL PRODUCTS

(71) Applicant: DANIELI & C. OFFICINE MECCANICHE S.p.A., Buttrio (IT)

(72) Inventors: Nicola Gagliardi, Buttrio (IT); Marco Ansoldi, Udine (IT); Nikolas Salvador, Sarmede (IT); Matteo Nobile, Ruda (IT)

(73) Assignee: DANIELI & C. OFFICINE MECCANICHE S.p.A., Buttrio (IT)

( * ) Notice: Subject to any disclaimer, the term of this patent is extended or adjusted under 35 U.S.C. 154(b) by 0 days.

(21) Appl. No.: 17/421,178

(22) PCT Filed: Jan. 16, 2020

(86) PCT No.: PCT/IB2020/050343

§ 371 (c)(1),
(2) Date: Jul. 7, 2021

(87) PCT Pub. No.: WO2020/148698

PCT Pub. Date: Jul. 23, 2020

(65) Prior Publication Data

US 2022/0072604 A1 Mar. 10, 2022

(30) Foreign Application Priority Data

Jan. 16, 2019 (IT) ..... 102019000000693

(51) Int. Cl.
*B22D 11/06* (2006.01)

(52) U.S. Cl.
CPC ..... *B22D 11/0662* (2013.01); *B22D 11/068* (2013.01); *B22D 11/0622* (2013.01)

(58) Field of Classification Search
CPC ..... B22D 11/0662
See application file for complete search history.

(56) References Cited

U.S. PATENT DOCUMENTS 5,251,685 A * 10/1993 Praeg ..... B22D 11/0662 164/428
2004/0050530 A1* 3/2004 Bhamidipati ..... B22D 11/0662 164/467

(Continued)

FOREIGN PATENT DOCUMENTS

JP H08257697 A 10/1996
KR 20140108752 A 9/2014
KR 20170021553 A 2/2017

OTHER PUBLICATIONS

Martin McBrien et al: "Tailor Blank Casting-Control of sheet width using an electromagnetic edge dam in aluminlum twin roll casting", Journal of Materials Processing Technology, vol. 224, Apr. 1, 2015 (Apr. 1, 2015), pp. 60-72, XP055200043, ISSN: 0924-0136, DOI: 10.1016/j.jmatprotec.2015.03.034.

(Continued)

*Primary Examiner* — Kevin E Yoon
*Assistant Examiner* — Jacky Yuen
(74) *Attorney, Agent, or Firm* — STETINA BRUNDA GARRED AND BRUCKER

(57) ABSTRACT

An electromagnetic device for laterally containing a liquid metal, having a first electrical conductivity, at one open side end of a passage defined between two counter-rotating casting rolls, at least the surfaces of which are made of a ferromagnetic material, said device comprising a magnetic yoke made of a further ferromagnetic material having a second electrical conductivity either lower than or equal to said first electrical conductivity of the liquid metal and ending with two mutually proximal wedge-shaped ends, said wedge-shaped ends having respective inner surfaces, facing each other and defining a gap, and respective outer surfaces, arranged one on one side and the other on the other side with respect to a plane lying in said gap and shaped so as to be able (Continued)

to insert both said wedge-shaped ends at least partially between the two casting rolls;

at least one coil wound on at least one stretch of the magnetic yoke and adapted to be supplied by electric current;

at least one plate, made of a material having a third electrical conductivity either greater than or equal to said first electrical conductivity, said at least one plate being inserted in said gap so as to shield said inner surfaces with respect to each other.

20 Claims, 5 Drawing Sheets

(56) References Cited

U.S. PATENT DOCUMENTS

2007/0095499 A1 5/2007 Tomes et al.
2017/0136526 A1 5/2017 Allwood et al.

OTHER PUBLICATIONS

Martin McBrien et al: "Preliminary Design and Assessment of a Novel Electromagnetic Edge Dam for Aluminium Twin Roll Casting", Materials Science Forum, vol. 765, Jul. 31, 2013 (Jul. 31, 2013), pp. 87-91, XP055200044, DOI: 10.4028/www.scientific.net/MSF.765.87.

Gerber H et al: "Twin-Roll Casting With an Electromagnetic Edge Dam", Conference Record of the 2000 IEEE Industry Applications Conference. 35th IAS Annual Meeting and World Conference on Industrial Applications of Electrical Energy. Rome, Italy, Oct. 8-12, 2000; Conference Record of the IEEE Industry Applications Co, vol. Conf. 35, Oct. 8, 2000 (Oct. 8, 2000), pp. 2572-2577, XP001042663, DOI: 10.1109/IAS.2000.883185, ISBN: 978-0-7803-6402-8.

Patent Cooperation Treaty, International Search Report and Written Opinion for International Application No. PCT/IB2020/050343, dated May 19, 2020, 13 pages.

* cited by examiner

ELECTROMAGNETIC DEVICE FOR LATERALLY CONTAINING LIQUID METAL IN A CASTING OF METAL PRODUCTS

CROSS-REFERENCE TO RELATED APPLICATIONS

This application claims priority to PCT International Application No. PCT/IB2020/050343 filed on Jan. 16, 2020, which application claims priority to Italian Patent Application No. 102019000000693 filed on Jan. 16, 2019, the disclosures of which are expressly incorporated herein by reference.

STATEMENT RE: FEDERALLY SPONSORED RESEARCH/DEVELOPMENT

Not applicable.

BACKGROUND OF THE INVENTION

Field of the Invention

The present invention relates to an electromagnetic device for laterally containing liquid metal, particularly aluminum, in a casting of flat metal products, e.g. strips, according to technology commonly known as Twin Roll Casting. In this description, the term "aluminum" means both pure aluminum and any aluminum alloy.

Background Art

The technology commonly known as Twin Roll Casting is widely used in the production of aluminum strips and is characterized by the direct feeding of the liquid metal between two counter-rotating steel rolls, which are cooled, e.g. by water. In particular, this process requires a lateral containment of the cast metal in order to increase productivity and avoid material accumulation on the edges, with the consequent need to clean the solidified material waste from the edges themselves.

This can be achieved, for example, by simultaneously using a mechanical lateral containment device, or mechanical edge dam, and an electromagnetic lateral containment device, or electromagnetic edge dam.

However, many drawbacks occur using the solutions of the prior art, such as:

- difficulty in laterally containing the liquid metal subject to high head pressure by the liquid metal itself;
- rather small lateral containment region;
- lack of system flexibility, which does not allow different strip widths to be cast with the same steel rolls because the containment devices cannot act between the casting rolls but only outside them.

The need for an electromagnetic containing device capable of solving the aforesaid drawbacks is therefore felt.

SUMMARY OF THE INVENTION

It is an object of the present invention to make an electromagnetic device for laterally containing liquid metal, in particular aluminum, in a horizontal or vertical casting of strips according to the Twin Roll Casting technology, which is able to improve performance in terms of both containment of liquid metal at high pressures and extension of the lateral containment region.

It is another object of the present invention to make an electromagnetic liquid metal containment device which is flexible, allowing different strip widths to be cast with the same steel rolls.

The present invention achieves at least one of such objects, and other objects which will be apparent in light of the present description, by means of an electromagnetic device for laterally containing liquid aluminum or a liquid alloy thereof, having a first electrical conductivity, at one open side end of a passage defined between two counter-rotating casting rolls, said device comprising

- a magnetic yoke made of a first material having a second electrical conductivity either lower than or equal to said first electrical conductivity, said first material being ferromagnetic material and said magnetic yoke ending with two mutually proximal wedge-shaped ends, said wedge-shaped ends having respective inner surfaces, facing each other and defining a gap, and respective outer surfaces, arranged one on one side and the other on the other side with respect to a plane lying in said gap and shaped so as to be able to insert both said wedge-shaped ends at least partially between the two casting rolls;
- at least one coil wound on at least one stretch of the magnetic yoke and adapted to be supplied by electric current;
- at least one plate inserted in said gap;

wherein said at least one plate is made of a second material having a third electrical conductivity either greater than or equal to said first electrical conductivity, whereby said at least one plate electromagnetically shields said inner surfaces with respect to each other.

Another aspect of the invention relates to a casting machine for casting flat products made of aluminum or alloys thereof, comprising

- two counter-rotating casting rolls defining a passage, having two open side ends, for solidifying the liquid aluminum and forming a flat product;
- feeding means for feeding the liquid aluminum into a space between the two casting rolls;
- a first electromagnetic device with the features described above, inserted with both its wedge-shaped ends at least partially between the two casting rolls at a first open side end of said passage;
- preferably a second electromagnetic device with the features described above, inserted with both its wedge-shaped ends at least partially between the two casting rolls at a second open side end of said passage;
- preferably wherein said casting machine is a horizontal casting machine, said two counter-rotating casting rolls are superposed, and said feeding means are adapted to feed the liquid aluminum horizontally in the space between the two casting rolls.

A further aspect of invention relates to a casting process for casting flat products made of aluminum or alloys thereof, performed by means of the aforesaid casting machine, the process comprising the following steps:

- feeding liquid aluminum into the space between the two casting rolls by means of the feeding means;
- solidifying the liquid aluminum and forming a flat product in the passage between the two casting rolls;
- wherein a lateral containment of the liquid aluminum is provided at at least one of the two open side ends of the passage by means of a first electromagnetic device;
- preferably wherein a first lateral containment of the liquid aluminum is provided at a first open side end of said two side ends of the passage by means of said first electromagnetic device, and preferably a second lateral containment of the liquid aluminum is provided at a second open side end of said two side ends of the passage by means of a second electromagnetic device;

preferably wherein the casting process is performed by means of a horizontal casting machine.

Advantageously, the solution of the electromagnetic device or edge dam of the invention allows to meet the following requirements:

laterally containing the metal subject to high pressure, e.g. up to 150 mm of the liquid metal head;

the concerned lateral containment region can vary in length, e.g. from 50 to 90 mm (setback);

the system is flexible and allows different strip widths to be cast without having to replace the casting rolls with other rolls of different lengths.

The casting machine of the invention further exploits the magnetic properties of the casting rolls, preferably made of steel (at least on the outer part thereof, in contact with the product to be solidified), to convey the magnetic field generated by the at least one coil, first between said coil and a casting roll and then between the casting roll and the metal product, e.g. of aluminum, in the step of casting, thus generating eddy currents by induction, which, by interacting with the magnetic field, produce the Lorentz forces capable of contrasting the liquid metal head on the edge of the metal product.

The magnetic yoke can be made in a single piece of ferromagnetic material or made of a plurality of ferromagnetic sheets arranged on top of each other, or side by side, and electrically insulated from one another.

In both variants, the choice of the magnetic yoke material is important because the magnetic yoke as a whole must have a low electrical conductivity which significantly reduces the generation of eddy currents and therefore the need to cool the yoke intensively.

The presence of at least one plate, made of said second material, between the two wedge-shaped ends allows to:

avoid the closure of the magnetic field in the yoke itself, conveying the magnetic field towards a casting roll and promoting the generation of the containment force;

possibly cool the yoke or magnetic concentrator which heats up due to losses mainly due to hysteresis.

A better heat exchange between the metal of the casting product and the casting roll allows higher productivity (e.g. 10 m/min for aluminum strip thicknesses of 5 mm) and greater flexibility in production control.

Further features and advantages of the present invention will become more apparent in light of the detailed description of preferred, but not exclusive embodiments.

The dependent claims describe particular embodiments of the invention.

BRIEF DESCRIPTION OF THE FIGURES

The description of the invention refers to the accompanying drawings, which are provided by way of non-limiting example, in which.

DETAILED DESCRIPTION OF EXAMPLE EMBODIMENTS OF THE INVENTION

Figure 1:
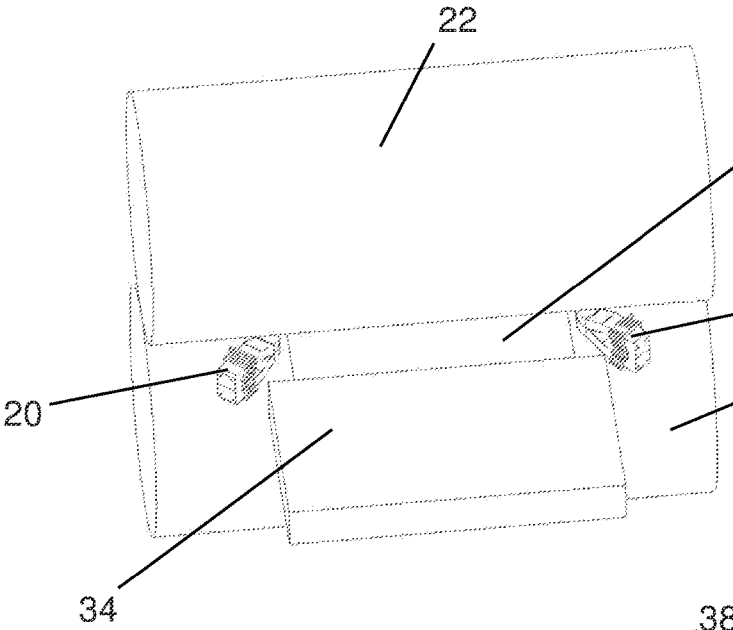
FIG. 1 shows a view of a horizontal casting machine with a lateral containment apparatus according to the invention.
Figure 2:
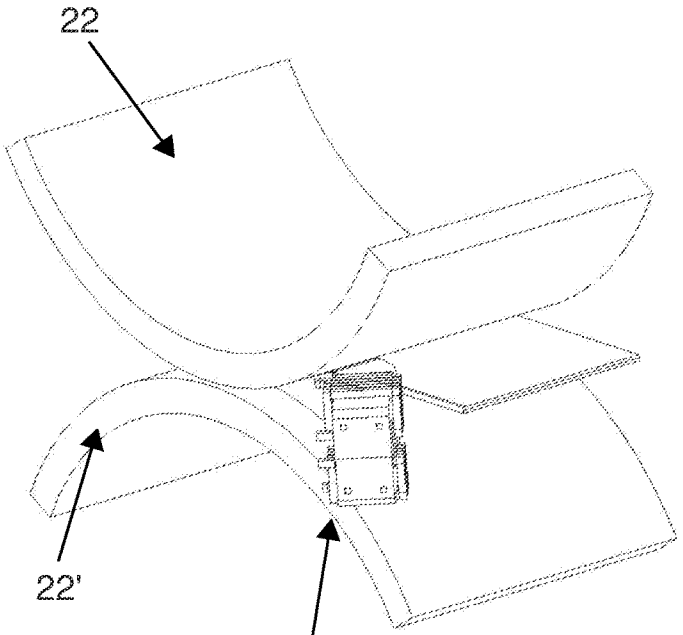
FIG. 2 shows a perspective view of an electromagnetic device of the invention.

FIG. 1 shows an example of a horizontal casting machine comprising a pair of electromagnetic devices 20, 21, which are the object of the present invention. However, the electromagnetic devices of the present invention can also be used in vertical casting machines.

The casting machine, in the horizontal version of which is illustrated in the Figures, for casting flat metal products, e.g. strips preferably made of aluminum, comprises:

two counter-rotating and superimposed casting rolls 22, 22' defining an outlet passage for the metal to be cast having two open side ends, for solidifying the liquid metal and forming a flat product;

feeding means to feed the liquid metal horizontally into a space between the two casting rolls, towards the passage defined between the two casting rolls;

a first electromagnetic device 20 inserted with its wedge-shaped ends 4, 4' at least partially between the two casting rolls at a first open side end of the passage;

preferably a second electromagnetic device 21 inserted with its wedge-shaped ends 4, 4' at least partially between the two casting rolls at a second open side end of said passage.

In this description, the term "aluminum" means both pure aluminum and any aluminum alloy with at least one metal, e.g. copper, zinc, manganese, silicon, or magnesium.

Advantageously, the aforesaid casting machine can not be equipped with any mechanical lateral containment device.

It is sufficient to use only one electromagnetic device if it is necessary to contain the liquid metal laterally only at one of the two side ends of said passage.

Preferably, at least the outer surfaces of the casting rolls 22, 22' are made of a ferromagnetic material, e.g. ferromagnetic steel.

The feeding means, known in themselves, comprise:

a tundish 34 for collecting the liquid metal, e.g. aluminum, for example coming from an inlet channel (not shown);

an unloader 35, preferably made of ceramic material, to feed the liquid metal coming from the tundish 34 horizontally towards the passage delimited by the two casting rolls 22, 22'.

Moving means 60 can be provided for moving the first electromagnetic device 20 and/or the second electromagnetic device 21 so as to adjust the distance from one another along a direction Z (FIG. 4) parallel to a plane containing the rotation axes of the two casting rolls 22, 22'. Such moving means 60 can be, for example, linear, hydraulic, pneumatic, mechanical, pneumatic actuators, combinations thereof or the like.

This allows to cast different widths of metal product, e.g. strips, without needing to replace the casting rolls. The transition from one strip size to be produced to another only requires the lateral displacement of at least one of the two electromagnetic lateral containment devices, with respect to the casting rolls, along the Z direction. This can also apply to only one electromagnetic device.

Therefore, the width of the casting rolls being the same, said width being fixed, the electromagnetic lateral containment device can be moved so as to define different widths of the strip to be cast, and therefore it is not necessary to have dedicated sets of rolls as in the prior art, in which the electromagnetic device cannot be displaced laterally and, therefore, the casting rolls must be changed whenever it is necessary to cast strips of different widths.

Each electromagnetic device 20, 21, suited for the lateral containment of the liquid metal during casting, at the respective open side end of the passage defined between the two casting rolls 22, 22', comprises:

- a magnetic yoke 1 made of a further ferromagnetic material having as a whole an electrical conductivity which is either lower than or equal to the electrical conductivity of the metal to be cast, and ending with two mutually proximal wedge-shaped ends 4, 4', said wedge-shaped ends 4, 4' having respective inner surfaces 5, 5', facing each other and defining a gap 6, and respective outer surfaces 7, 7', arranged opposite the corresponding inner surfaces 5, 5' and arranged one on one side and the other on another side with respect to a plane lying in said gap 6;
- at least one coil 8 wound on at least one stretch of the magnetic yoke 1 and adapted to be supplied by electric current;
- at least one plate 9, made of a material having a electrical conductivity either greater than or equal to the electrical conductivity of the metal to be cast, said at least one plate 9 being inserted in the gap 6 so as to electromagnetically shield the inner surfaces 5, 5' with respect to each other.

The outer surfaces 7, 7' of the two wedge-shaped ends 4, 4' are shaped so that both said wedge-shaped ends 4, 4' can be inserted at least partially between the two casting rolls 22, 22'.

Advantageously, the liquid metal to be cast to form the flat product, e.g. a strip, is aluminum or an aluminum alloy. In the step of casting, the temperature of these metals is comprised in the range from about 510° C. to 720° C. At this temperature the electrical conductivity of aluminum and alloys thereof is in the range from about 7 to 15 MS/m.

More specifically, the temperature of the aluminum in the step of casting is in the range from about 660° C. to 700° C. At this temperature, the electrical conductivity of aluminum is comprised in the range from 9 to 11 MS/m.

Therefore, it is important to choose the materials of magnetic yoke 1 and plate 9 in order to satisfy the following relationship during the step of casting of aluminum or alloy thereof $$\sigma_{plate} \geq \sigma_{Al} \geq \sigma_{yoke},$$

wherein $\sigma_{Al}$ is the electrical conductivity of aluminum or of an alloy thereof.

Preferably, the plate 9 is made of a material chosen from the following: copper, silver or other suitable metal.

For example, the electrical conductivity of the material of the plate 9 during said step of casting is at least 20 MS/m, e.g. about 40 MS/m.

Preferably, the temperature of the plate 9 is kept below about 200° C., e.g. in the range 170-180° C., during the casting of the aluminum or an alloy thereof.

Preferably, the magnetic yoke 1 is made of a ferromagnetic material, e.g. chosen from the following: silicon steel, "Fluxtrol" materials, e.g. Fluxtrol 100, or "Grey T Type" made by MagShape, or anyway materials having magneto-dielectric properties, due to the doping between iron elements and plastic elements constituting the magnetic yoke 1, which imply the reduction of the internal heating phenomenon due to the formation of eddy currents.

For example, the electrical conductivity of the ferromagnetic material of the magnetic yoke 1 during the aforesaid step of casting is less than or equal to 500 S/m, preferably less than or equal to 100 S/m.

Preferably, the temperature of the magnetic yoke 1 is kept below approx. 200° C., e.g. in the range 170-180° C., during the casting of aluminum or an alloy thereof.

Advantageously, each electromagnetic device 20, 21, and thus the respective magnetic yoke 1, is positioned laterally and in an outer position, e.g. completely outside, with respect to the zone occupied by the unloader or the feed tip 35.

Furthermore, the magnetic yoke 1 is not profiled to adapt to the unloader 35. The magnetic yoke 1 is instead profiled to define the aforesaid gap 6 in which the plate 9 is inserted, said plate being made of a conductive and magnetic material such as to electromagnetically shield the inner surfaces 5, 5', which are preferably flat and substantially parallel to each other. Therefore, the plate 9 is not transparent to the magnetic fields generated by the electromagnetic device.

Preferably, the gap or distance 6 between the inner surfaces 5, 5', facing each other, of the two wedge-shaped ends 4, 4' is in a range from 2 to 25 mm, preferably 4 to 8 mm. Optionally, the plate 9, or at least the part of plate 9 arranged between the two inner surfaces 5, 5', has a thickness in the range from 1.5 to 24.5 mm, preferably from 3.5 to 7.5 mm. Therefore, due to the shape of the outer surfaces 7, 7' of the wedge-shaped ends 4, 4', and due to the fact that the gap 6 and, therefore, the plate 9 are very thin, the magnetic field flux, appropriately diverted by the plate 9, enters into a casting roll and crosses the space between the casting rolls, crossing the aluminum to be cast, in a point in which this space is very narrow. For example, considering a casting roll diameter of 880 mm, the magnetic field flux between the casting rolls makes a path of about 5-6 cm when it exits the wedge-shaped end 4 and then closes in the other wedge-shaped end 4'.

Preferably, the two wedge-shaped ends 4, 4' are arranged symmetrically with respect to a symmetry plane lying in the gap 6, with the respective inner surfaces 5, 5' substantially parallel and proximal to said symmetry plane, and the respective outer surfaces 7, 7', flat or curved, distal from the symmetry plane but substantially converging towards said symmetry plane so as to define the wedge shape.

In a variant, the outer surfaces 7, 7' of the wedge-shaped ends 4, 4' are curvilinear with a radius of curvature substantially equal to the outer radius of the corresponding casting roll. Each wedge-shaped end 4, 4' is also provided with two further lateral surfaces 26 that are transverse, preferably perpendicular, to the inner surface 5, 5', and joining the inner surface 5, 5' to the respective outer surface 7, 7'.

Figure 9:
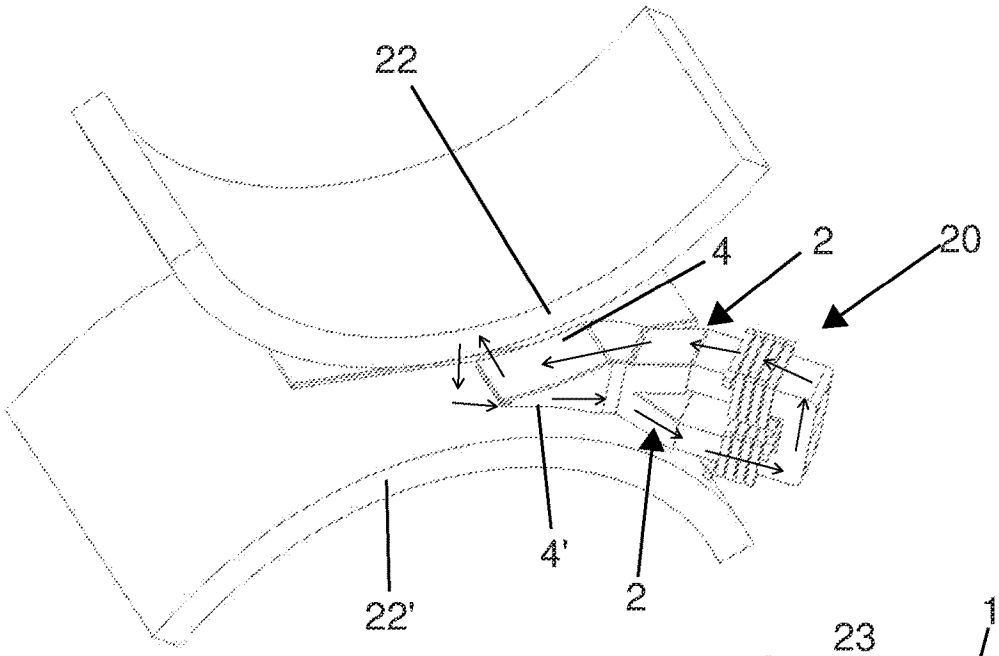
FIG. 9 diagrammatically shows the path of the magnetic field generated by the electromagnetic device of the invention.

Advantageously, the lateral containment of the liquid metal is achieved by supplying electrical current to at least one coil 8 so that, by virtue of the magnetic properties of the materials of some components of the casting machine and the relation between the electrical conductivities of the different materials used, the magnetic field flux produced by the coil 8 passes in succession, as shown in FIG. 9:

- from the body 2 of the magnetic yoke 1 to a first wedge-shaped end 4 thereof,
- from said first wedge-shaped end 4 to a first casting roll 22,
- from said first casting roll 22 to the second casting roll 22' through the metal product advancing between the two casting rolls, thus generating eddy currents by induction with consequent production of Lorentz forces for the lateral containment of the liquid metal on the edge of the product which is transiting between the two casting rolls,
- from said second casting roll 22' to the second wedge-shaped end 4' of the magnetic yoke 1,
- and from said second wedge-shaped end 4' again to the body 2 of the magnetic yoke 1.

Preferably, if the casting process is performed by means of a horizontal casting machine, the passage of the magnetic field flux from the first roll 22 to the second roll 22' is substantially vertical; while, if the casting process is performed by means of a vertical casting machine, the passage of the magnetic field flux from the first roll 22 to the second roll 22' is substantially horizontal.

By way of example only, during the operation of the device of the invention, the minimum distance between the electromagnetic device and the casting roll, i.e. the minimum distance between the outer surfaces 7, 7' of the wedge-shaped ends 4, 4' and the corresponding casting roll, is about 0.5-2 mm, e.g. about 1 mm. Preferably, the distance between the electromagnetic device and the liquid metal is about 8-12 mm, e.g. 10 mm.

Advantageously, the electrical conductivity of the material of the plate 9 prevents the magnetic field from closing in the yoke itself, thereby conveying the magnetic field flux from the wedge-shaped end 4 towards the surface of the proximal casting roll 22, made of ferromagnetic material, thus promoting the containment force.

Figure 3:
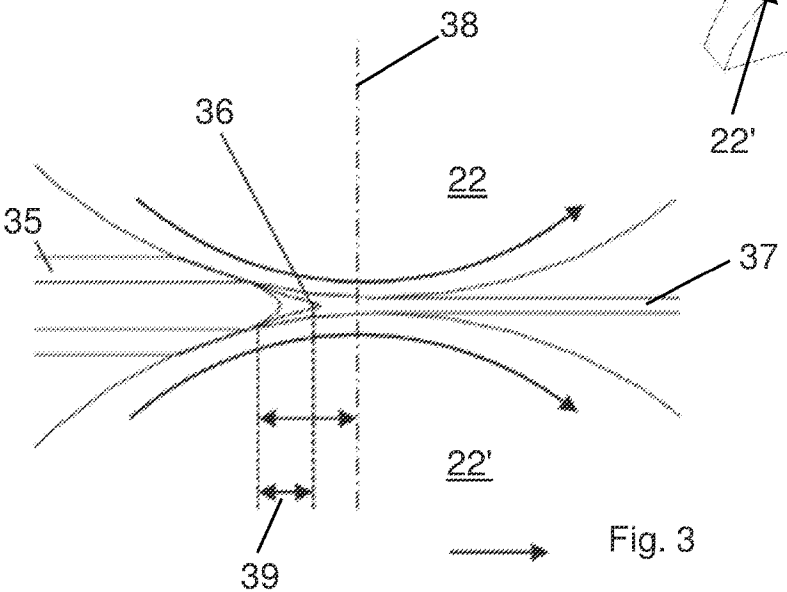
FIG. 3 shows a cross-section of the casting machine which shows the solidification area.
Figures 4, 5:
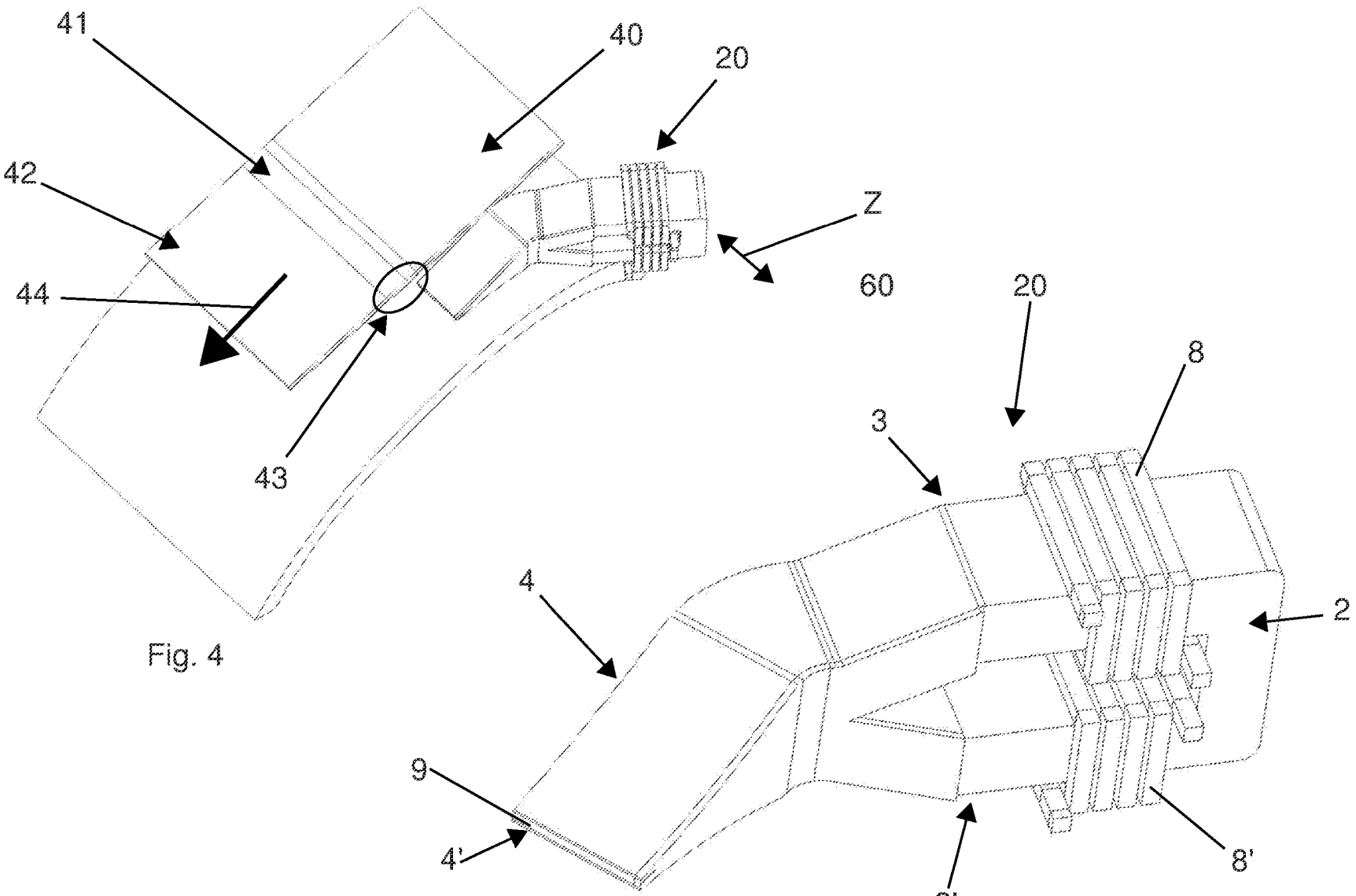
FIG. 4 shows a perspective view, from the top, of the part in FIG. 2 without the upper roll.
FIG. 5 shows a perspective view of an electromagnetic device of the invention.
Figure 7:
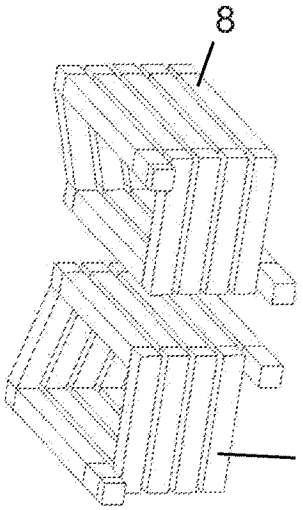
FIG. 7 shows a perspective view of second components of the device in FIG. 5.

A solidification process of the liquid metal through the casting machine is shown in FIGS. 1-4. In this process, the products, e.g. strips or sheets, are cast directly by means of the liquid metal feed, through the unloading device 35, between two cooled and counter-rotating casting rolls 22, 22'. A cross-section of the solidification region is shown in FIG. 3. As soon as the liquid metal touches the rolls 22, 22', a solid shell starts forming, growing towards outlet passage 38. The solid shells adhering to the upper roll 22 and to the lower roll 22' meet in a solidification point 36 just before the outlet passage 38 (usually the total solidification length is about 10-20 mm for a conventional process with a casting speed of about 1.2 m/min and a metal sheet thickness of 5 mm) and from there the metal product is deformed by the casting rolls 22, 22', obtaining the cast product 37. With reference to FIG. 4, the electromagnetic device or edge dam 20 is used to handle the metal by applying pressure along the sump depth 39 (FIG. 3, corresponding to the actual solidification length) during casting. This pressure, by virtue of the aforesaid Lorentz Forces, controls the position of the side edge of the metal in the region between the unloader 35 and the outlet passage 38, where a real physical containment is absent. Diagrammatically in FIG. 4, in which the direction of casting is indicated by reference numeral 44, the region in which the liquid metal is physically contained inside the unloader 35 is indicated by reference numeral 40; the solidification region in which the liquid metal is not physically contained laterally is indicated by reference numeral 41; the region in which the cast product is completely solid and reduced in thickness is indicated by the reference numeral 42; and the lateral region (circled in FIG. 4) in which the liquid metal is contained by the Lorentz Forces, by means of the electromagnetic device 20, is indicated by the reference numeral 43.

Figure 6:
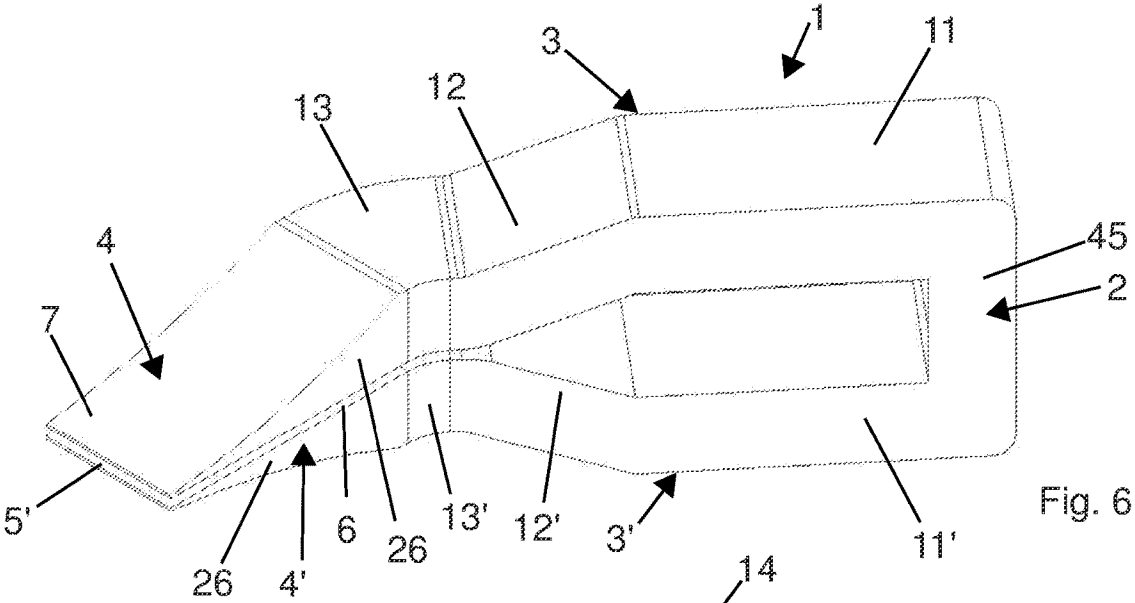
FIG. 6 shows a perspective view of a first component of the device in FIG. 5.

Preferably, as shown in FIGS. 5 and 6, the magnetic yoke 1 has the body 2 provided with two arms 3, 3', each arm ending with the respective wedge-shaped end 4, 4'.

In the case of horizontal casting, the two wedge-shaped ends 4, 4' are arranged one above the other.

In a variant, shown in FIG. 6, the arms 3, 3' comprise:

- a respective first stretch 11, 11', said first stretches 11, 11' being spaced apart and substantially parallel to each other,
- and a respective second stretch 12, 12', said second stretches 12, 12' being inclined in respective mutually converging directions and each connecting a respective first stretch 11, 11' to the respective wedge-shaped end 4, 4'.

The body 2 is provided with an further stretch 45 connecting the first stretches 11, 11' and arranged in a distal position from the wedge-shaped ends 4, 4'.

Preferably, the first stretches 11, 11' and second stretches 12, 12' are arranged along a first plane, and third curved stretches 13, 13' are provided which connect a respective second stretch 12, 12' to the respective wedge-shaped end 4, 4'. The two wedge-shaped ends 4, 4' are therefore arranged along a second plane which is inclined with respect to the first plane by an angle greater than 90°, preferably between 120 and 150°.

In an embodiment of the present invention, the body 2 of magnetic yoke 1, having the shape described above, is made of a ferromagnetic material, e.g. silicon steel, and can be formed by a single solid piece of such ferromagnetic material. In another embodiment, the body 2 of the magnetic yoke 1 can be formed by a series of ferromagnetic sheets which are bent and fixed together, using mechanical means, an adhesive or similar means to provide the desired configuration, said ferromagnetic sheets being insulated from each other by means of insulators, using a technology similar to that used for the composition of the ferromagnetic cores of the transformers.

Figure 8B:
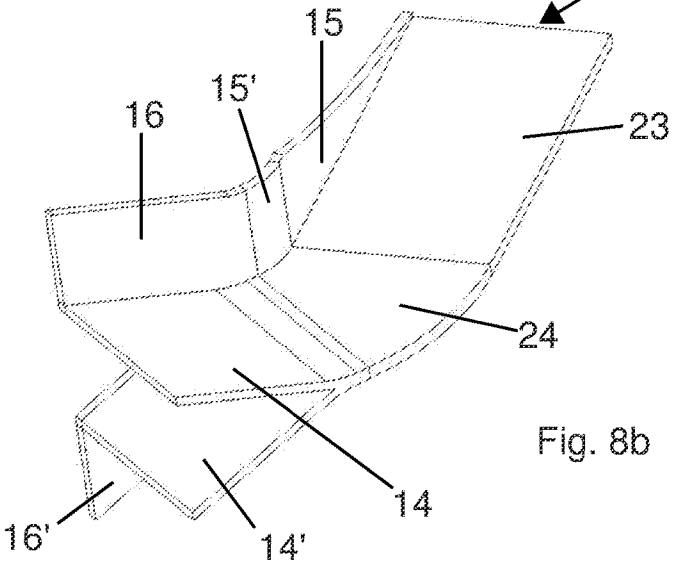
FIG. 8*b* shows a second perspective view of said third component.
Figure 8A:
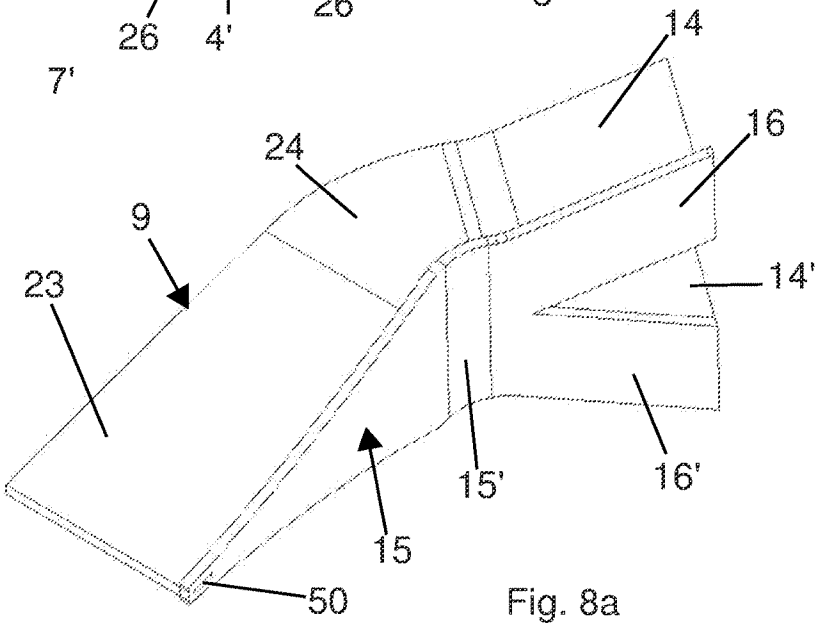
FIG. 8*a* shows a first perspective view of a third component of the device in FIG. 5.

Preferably, the at least one plate 9, preferably a single plate 9, in the variant shown in FIGS. 8*a* and 8*b*, comprises a flat part 23 arranged between the inner surfaces 5, 5' of the wedge-shaped ends 4, 4'. The thickness of said flat part 23 is preferably in the range from about 1.5 to 24.5 mm, e.g. from 3.5 to 7.5 mm.

Optionally, said flat part 23 is provided, at one end thereof, with a bifurcation with diverging stretches 14, 14' substantially parallel to the second stretches 12, 12' of the arms 3, 3' of the magnetic yoke 1. The space between the two diverging stretches 14, 14' can be either empty, as shown in the Figures, or full whereby a material block is provided having the aforesaid diverging stretches 14, 14' as two opposite surfaces. Preferably, the flat part 23 has a curved end stretch 24 arranged between the third curved stretches 13, 13' of the magnetic yoke and connected to the diverging stretches 14, 14'.

The plate 9 is preferably also provided, at a side edge 47 thereof (FIG. 10), with a wall 15 (FIGS. 8*a*, 8*b*) which is transversal, preferably orthogonal, to the flat part 23 and shaped to cover a side surface 26 of both the wedge-shaped ends 4, 4'.

The wall 15 is also provided with a respective bifurcation with respective diverging stretches 16, 16' which are transversal, preferably perpendicular, to the diverging stretches 14, 14' of the plate 9 and shaped so as to cover a flank of said second stretches 12, 12' of the body 2 of the magnetic yoke 1. Preferably, a curved stretch 15' connects the main body of the wall 15 to the diverging stretches 16, 16'.

Preferably, the plate 9 is fixed to the magnetic yoke 1, e.g. by means of an adhesive binder. Any epoxy adhesive which has the following characteristics can be used:

stability to high temperatures;
chemical resistance;
low moisture absorption;
good thermal conductivity;
high adhesion strength;
electrically non-conductive.

In particular, the flat part 23, e.g. rectangular, is fixed to the inner surfaces 5, 5' of the wedge-shaped ends 4, 4'; the diverging stretches 14, 14' are fixed to the respective second stretches 12, 12' of the body 2; the curved end stretch 24 is fixed to the third curved stretches 13, 13'; the wall 15 is fixed to the side surfaces 26 of both wedge-shaped ends 4, 4'. Furthermore, in particular, the curved stretch 15' of the wall 15 is fixed to the inner surfaces of the curved stretches 13, 13' of the body 2, while the diverging stretches 16, 16' of the wall 15 are fixed to a flank of the corresponding second stretch 12, 12' of the body 2.

Advantageously, the plate 9 can be provided with cooling means. These cooling means comprise at least one channel 10 made inside the plate 9, and which can be connected to a supply circuit of cooling liquid, e.g. water.

Figure 10:
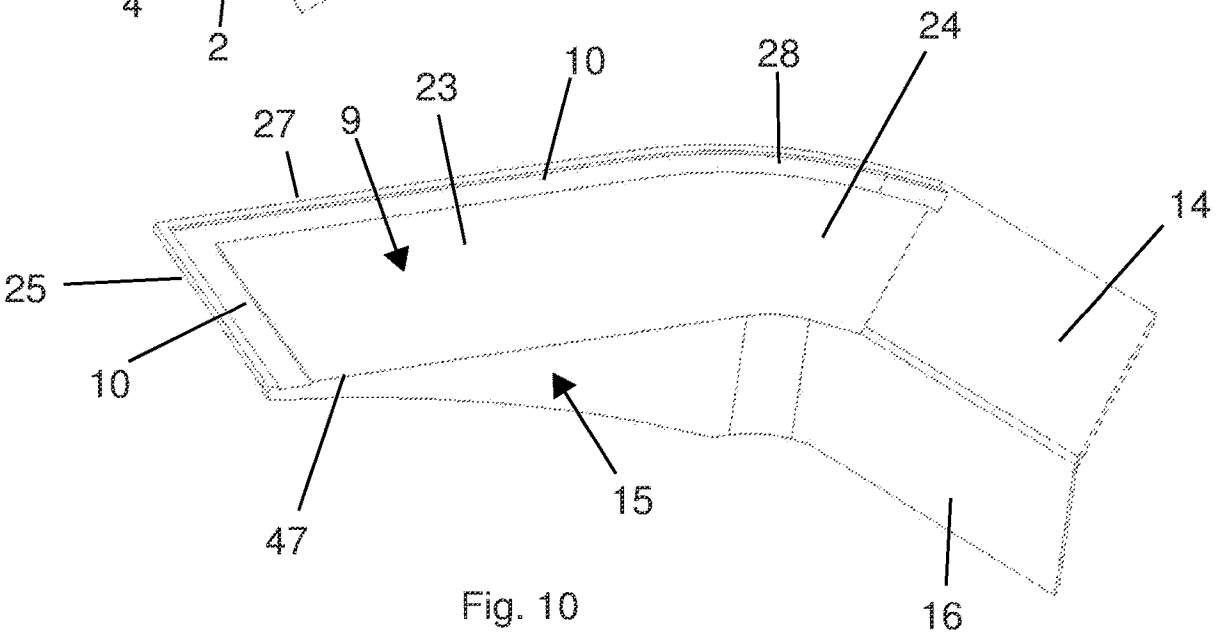
FIG. 10 shows a partial section view of said third component.

In a variant shown in the partially sectioned view of FIG. 10, in which for a better understanding the upper part of the wall 15 is not visible, a channel 10, inside the plate 9, is made in proximity of two edges of the plate 9, and in particular along the edge 25, corresponding to the tip of the wedge-shaped ends 4, 4', and along the edge 27, i.e. the edge of the plate 9 which in operating position is proximal to the lateral end of the passage of the product to be cast, and therefore distal from wall 15. This configuration allows the removal of the heat generated by the Joule effect in the part of the magnetic yoke 1 proximal to the passage of the product to be cast, keeping the yoke temperature below about 180° C.

Preferably, the channel 10 has substantially a L-shape in plan, with the short stretch along the edge 25 and the long stretch along the edge 27. Preferably, the cooling liquid, supplied by the supply circuit (not shown), enters the channel 10 from an end of the edge 25 and exits the channel 10 from an end of the edge 27. In particular, the wall 15 is provided with a slot 50 (FIG. 8*a*) to let the cooling liquid into the channel 10, at the end of the edge 25.

The long stretch of the channel 10, along the edge 27, can have a curved end 28 at the curved end stretch 24 of the flat part 23 of the plate. Preferably, in this case, the cooling liquid, supplied by the supply circuit, enters the channel 10 from an end of the edge 25, proximal to the wall 15, and exits the channel 10 from the curved end thereof, distal from the edge 25.

In addition to the channel 10, suitable cooling systems can be provided to cool the outer walls of the entire wall 15 and of the diverging stretches 14, 14' of the plate 9.

In a variant shown in FIG. 5, there are provided two coils 8, 8' connected in series, each coil 8, 8' being wound on a first stretch 11, 11' of a respective arm 3, 3' of the magnetic yoke 1. The use of more than two coils is not excluded. The coils, e.g. made of copper, are preferably hollow and/or preferably internally water-cooled.

Advantageously, at least one cooling circuit can be provided which runs through at least one first stretch 11, 11' of the arms 3, 3'.

Figure 11:
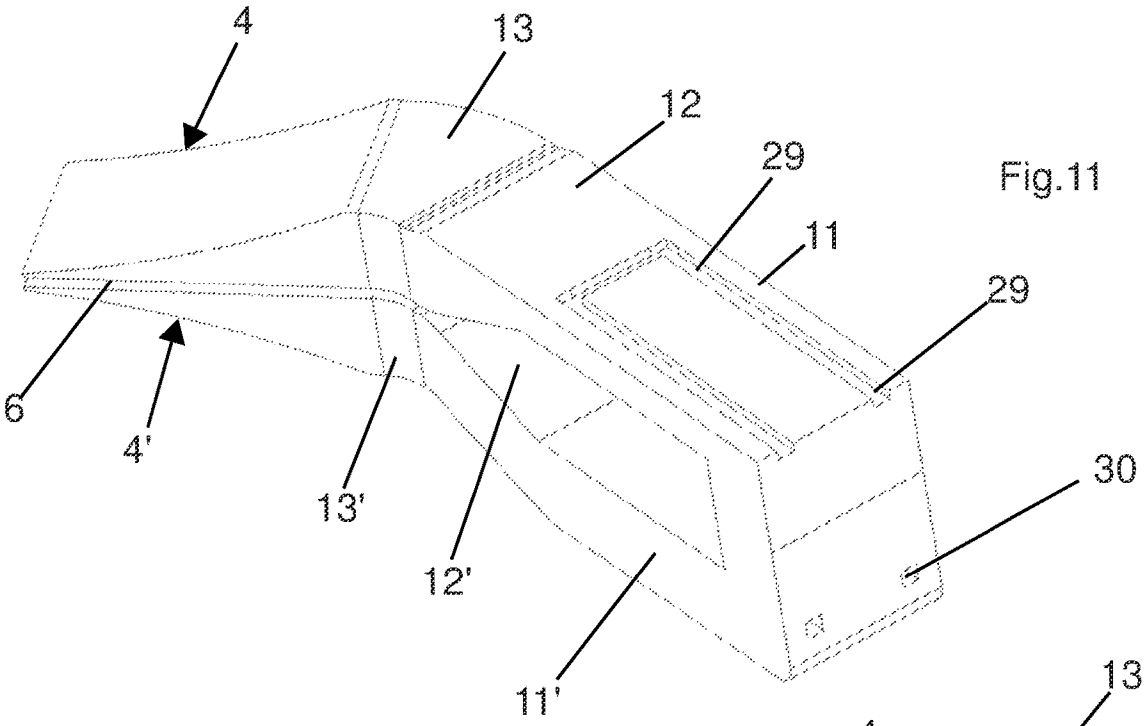
FIG. 11 shows a partial section perspective view of the device in FIG. 5.
Figure 12:
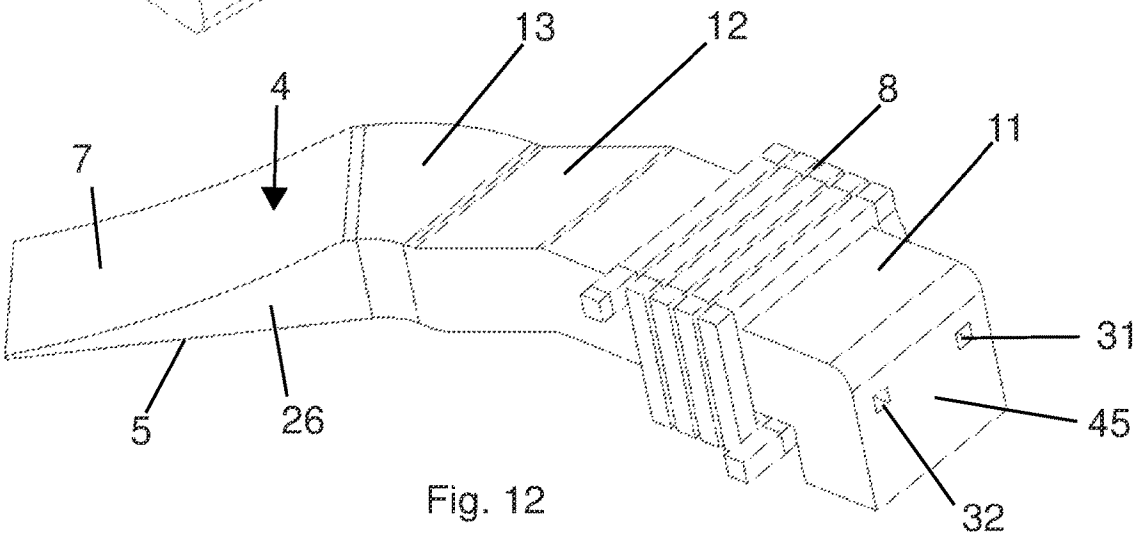
FIG. 12 shows a further perspective view of half of the device in FIG. 5.

Preferably, as shown in FIGS. 11 and 12, two cooling circuits are provided, one passing through at least the first stretch 11 of the arm 3 on which the coil 8 is wound, and the other passing through at least the first stretch 11' of the arm 3' on which the coil 8' is wound.

A respective channel or duct 29, 30, e.g. U-shaped, can be made or inserted inside the arms 3, 3'. Openings 31, 32 for letting the cooling liquid in and out of channel 29 or channels 29, 30, respectively, are provided in the body 2, e.g. in stretch 45.

According to a further aspect of the invention, an electromagnetic device 20 is provided, preferably adapted to contain laterally liquid aluminum or a liquid alloy thereof at an open side end of a passage defined between two counter-rotating casting rolls 22, 22'. Said device comprises a magnetic yoke 1 made of a first material having a first electrical conductivity, said first material being ferromagnetic material and said magnetic yoke ending with two mutually proximal wedge-shaped ends 4, 4', said wedge-shaped ends having respective inner surfaces 5, 5', facing each other and defining a gap 6, and respective outer surfaces 7, 7', arranged one on one side and the other on the other side with respect to a plane lying in said gap;

at least one coil 8 wound on at least one stretch of the magnetic yoke 1 and adapted to be supplied by electric current;

at least one plate 9 inserted in said gap 6;

characterized in that said at least one plate 9 is made of a second material having a second electrical conductivity which is either greater than or equal to said first electrical conductivity, whereby said at least one plate 9 can electromagnetically shield said inner surfaces 5, 5' with respect to each other.

Optionally, the first electrical conductivity of the first material is either less than or equal to 500 S/m and the second electrical conductivity of the second material is at least 20 MS/m at a second temperature comprised in the range from about 170° C. to 200° C.

Indeed, during the casting of aluminum or of the alloy thereof, the plate 9 and the magnetic yoke 1 are preferably kept at said second temperature. Preferably, the plate 9 is made of a material chosen from copper or silver or other suitable metal; and the magnetic yoke 1 is made of a ferromagnetic material chosen from silicon steel or Fluxtrol materials or "Grey T Type" material or other suitable ferromagnetic material.

Optionally, said at least one plate 9 is provided with cooling means, preferably comprising at least one channel 10 formed inside said at least one plate 9 which can be connected to a cooling liquid feeding circuit.

The magnetic yoke 1, the plate 9 and the at least one coil 8, 8' can have the technical features of the variants described above or claimed in claims 5 to 12.

The invention claimed is:

1. An electromagnetic device for laterally containing liquid aluminum or a liquid aluminum alloy, having a first electrical conductivity, at one open side end of a passage defined between two counter-rotating casting rolls, said device comprising a magnetic yoke made of a first material having a second electrical conductivity either lower than or equal to said first electrical conductivity, said first material being ferromagnetic material and said magnetic yoke ending with two mutually proximal wedge-shaped ends, said wedge-shaped ends having respective inner surfaces, which are flat and substantially parallel to each other and face each other defining a gap, and respective outer surfaces, arranged one on one side and the other on the other side with respect to a plane lying in said gap, said outer surfaces of the two wedge-shaped ends being converging towards said plane so as to define a wedge shape whereby both said wedge-shaped ends can be inserted at least partially between the two casting rolls;

at least one coil wound on at least one stretch of the magnetic yoke and adapted to be supplied by electric current;

at least one plate inserted in said gap;

wherein said at least one plate is made of a second material having a third electrical conductivity either greater than or equal to said first electrical conductivity, whereby said at least one plate can electromagnetically shield said inner surfaces with respect to each other;

wherein said at least one plate comprises a flat part arranged between the flat and substantially parallel inner surfaces of the wedge-shaped ends.

2. The device according to claim 1, wherein said at least one plate is provided with cooling means.

3. The device according to claim 2, wherein said cooling means comprise at least one channel formed inside said at least one plate and connectable to a cooling liquid feeding circuit.

4. The device according to claim 1 wherein:

the first electrical conductivity of the liquid aluminum or a liquid alloy thereof is comprised in a range from about 7 to 15 MS/m at a first temperature comprised in a range from about 510° C. to 720° C.; wherein the second electrical conductivity of the first ferromagnetic material is either less than or equal to 500 S/m and the third electrical conductivity of the second material is at least 20 MS/m at a second temperature comprised in a range from about 170° C. to 200° C., wherein the at least one plate is made of a material chosen from copper, silver or other suitable metal; and wherein the magnetic yoke is made of a ferromagnetic material chosen from silicon steel or other suitable ferromagnetic material.

5. The device according to claim 1, wherein the magnetic yoke has a body provided with two arms, each arm ending with a respective wedge-shaped end and having in succession:

respective first stretches which are spaced apart and substantially parallel, and respective second stretches inclined in respective mutually converging directions, each second stretch connecting a respective first stretch to the respective wedge-shaped end.

6. The device according to claim 5, wherein the first stretches and second stretches are arranged along a first plane, and third curved stretches are provided which connect a respective second stretch to the respective wedge-shaped end; wherein said wedge-shaped ends are arranged along a second plane which is inclined with respect to the first plane by an angle greater than 90°.

7. The device according to claim 5, wherein said at least one plate is provided with a bifurcation with diverging stretches substantially parallel to said second stretches.

8. The device according to claim 7, wherein said at least one plate is provided, at a side edge thereof, with a wall transversal to a flat part of the plate arranged between the inner surfaces of the wedge-shaped ends, said wall being shaped so as to cover a side of said wedge-shaped ends; wherein said wall is provided with a respective bifurcation with respective diverging stretches transversal to the diverging stretches of the plate and shaped so as to cover a side of said second stretches.

9. The device according to claim 5, wherein there are provided at least two coils connected in series, each coil being wound on a first stretch of a respective arm of the magnetic yoke.

10. The device according to claim 9, wherein there is provided at least one cooling circuit which crosses the first stretches of a respective arm of the magnetic yoke.

11. The device according to claim 1, wherein a thickness of said flat part is comprised in a range from 1.5 to 24.5 mm, while the gap is comprised in a range from 2 to 25 mm.

12. The device according to claim 1, wherein the magnetic yoke is made in one piece, or is constituted by a plurality of ferromagnetic sheets either overlapping or side-by-side, and isolated from each other.

13. The device according to claim 1, wherein the outer surfaces of the wedge-shaped ends are curvilinear with a radius of curvature substantially equal to an outer radius of the corresponding casting roll.

14. The device according to claim 1, wherein the two wedge-shaped ends are arranged symmetrically with respect to a symmetry plane lying in the gap, with the respective inner surfaces substantially parallel and proximal to said symmetry plane, and the respective outer surfaces, flat or curved, distal from the symmetry plane but substantially converging towards said symmetry plane so as to define the wedge shape.

15. A casting machine for casting flat products made of aluminum or alloys thereof, comprising:

two counter-rotating casting rolls defining a passage having two open side ends, for solidifying liquid aluminum and forming a flat product;

feeding means for feeding the liquid aluminum into a space between the two counter-rotating casting rolls;

a first electromagnetic device according to claim 1, inserted with both its wedge-shaped ends at least partially between the two counter-rotating casting rolls at a first open side end of said passage;

a second electromagnetic device according to claim 1, inserted with both its wedge-shaped ends at least partially between the two counter-rotating casting rolls at a second open side end of said passage.

16. The machine according to claim 15, wherein at least the outer surfaces of the two counter-rotating casting rolls are made of a third material, said third material being ferromagnetic.

17. The machine according to claim 15, wherein moving means are provided for moving said first electromagnetic device and/or said second electromagnetic device so as to adjust a distance from one another along a direction (Z) parallel to a plane containing rotation axes of the two counter-rotating casting rolls whereby different widths of flat product can be cast using the same counter-rotating casting rolls.

18. A casting process for casting flat products made of aluminum or alloys thereof, using the casting machine according to claim 13, the process comprising the following steps:

feeding liquid aluminum into the space between the two counter-rotating casting rolls-by means of the feeding means;

solidifying the liquid aluminum and forming a flat product in the passage between the two counter-rotating casting rolls;

wherein a lateral containment of the liquid aluminum is provided at least one of the two open side ends of the passage by means of the first electromagnetic device;

wherein a first lateral containment of the liquid aluminum is provided at a first open side end of the passage by means of said first electromagnetic device and a second lateral containment of the liquid aluminum is provided at a second open side end of said passage by means of the second electromagnetic device.

19. The process according to claim 18, wherein, for each of said first electromagnetic device and second electromagnetic device, the lateral containment of the liquid aluminum is obtained by supplying electric current to the at least one coil, whereby a magnetic field flux produced by the coil passes in succession from a body of the magnetic yoke to a first wedge-shaped end, from said first wedge-shaped end to a first roll of said two counter-rotating casting rolls, from said first roll to a second roll of said two counter-rotating casting rolls through an aluminum advancing between the counter-rotating casting rolls, thus generating eddy currents by induction with consequent production of Lorentz forces for the lateral containment of the liquid aluminum on an edge of the product transiting between the two counter-rotating casting rolls, from said second roll to a second wedge-shaped end, and from said second wedge-shaped end again to the body of the magnetic yoke;

and wherein, if the casting process is performed by means of a horizontal casting machine, a passage of the magnetic field flux from said first roll to said second roll is substantially vertical; while, if the casting process is performed by means of a vertical casting machine, the passage of the magnetic field flux from said first roll to said second roll is substantially horizontal.

20. The process according to claim 18, wherein during the casting between the two counter-rotating casting rolls temperature of the aluminum or alloy thereof is in the range from about 510° C. to 720° C., while temperature of the plate and of the magnetic yoke is kept below about 200° C.

* * * * *